United States Patent [19]

Nipper, Jr.

[11] 4,003,571

[45] Jan. 18, 1977

[54] ROCKING DEVICE

[75] Inventor: William U. Nipper, Jr., Swainsboro, Ga.

[73] Assignee: Karrh & Malone, Swainsboro, Ga.

[22] Filed: Mar. 15, 1976

[21] Appl. No.: 667,192

[52] U.S. Cl. ..... 272/56

[51] Int. Cl.[2] ..... A63G 11/00

[58] Field of Search ..... 272/56, 54, 55, 52, 272/52.5, 53.1, 109, 111, 112, 113; 297/247, 258, 259, 260, 261, 262, 263, 264, 265, 266, 267, 268, 269, 270, 271, 272; D34/5 B, 5 C, 5 D

[56] References Cited

UNITED STATES PATENTS

| | | | |
|---|---|---|---|
| 451,583 | 5/1891 | Spencer | 272/56 |
| 915,793 | 3/1909 | Parmenter | 272/56 |
| 1,401,906 | 12/1921 | Haugh | 272/56 |
| 1,493,084 | 5/1924 | Strniste | 272/52 UX |
| 1,695,737 | 12/1928 | Molsdale | 272/56 UX |
| 3,010,719 | 11/1961 | Johnson | 272/56 |
| D138,706 | 9/1944 | Flesh et al. | D34/5 D |

FOREIGN PATENTS OR APPLICATIONS

| | | | |
|---|---|---|---|
| 243,994 | 5/1960 | Australia | 272/56 |
| 131,103 | 1/1949 | Australia | 272/56 |
| 228,026 | 4/1960 | Australia | 272/56 |

OTHER PUBLICATIONS

The EverWear Kindergarten Rocking Teeter, from EverWear Catalog No. 40, p. 7, The EverWear Manufacturing Co., Springfield, Ohio.

"Rocketeeter", Playthings, Mar. 1959.

*Primary Examiner*—Richard C. Pinkham
*Assistant Examiner*—Arnold W. Kramer
*Attorney, Agent, or Firm*—Cushman, Darby & Cushman

[57] ABSTRACT

A rocking device for children is provided which allows safe rocking during use thereof. A pair of rockers, a cross member and end seat members are attached together. The particular relationship between these members insures that a user's toes will normally not be in position to be squashed between the rockers and the surface on which the rocking device rocks, and insures that if a user places his fingers underneath the seat his fingers will not be squashed between the seal and the rocking surface. The rockers are substantially in abutting engagement at the free ends thereof and are relatively widely spaced at the base and middle portions thereof. Hand holds and a middle seat also are provided.

2 Claims, 3 Drawing Figures

ROCKING DEVICE

BACKGROUND AND SUMMARY OF THE INVENTION

This invention relates to a rocking device that may be used as an amusement device for children. While there have been a large number of prior proposals for children's rocking devices (for example, see U.S. Pat. Nos. 1,493,882, 1,270,219 and Design 189,670) such prior art proposals have had several safety problems associated therewith. With previous proposed rocking devices, if a child placed his fingers under the seat on which he was sitting and the device rocked back to its maximum tilted position, the child's fingers would be pinched between the seat and floor. Also with previous proposed rocking devices, the child's feet could readily be placed on the floor outside the rocker and his toes caught underneath the rocker as they rocked back and forth. Additionally, prior proposed rockers were subject to tilting over sideways if rocking thereon was too violent, or even tilted over backwards.

According to the present invention, a rocking device is provided that eliminates all of the above-mentioned safety problems that are inherent to some extent or the other in prior proposed rocking devices. According to the present invention, a rocking device is provided that has a pair of curved rockers that are attached together at the free ends thereof, and attached to a cross member at their free ends; the cross member extending from one set of rocker free ends to the other. The rockers, while adjacent to each other at the free ends thereof, flair outwardly from the free ends thereof so that they are spaced a relatively large distance from each other at middle portions thereof. The narrow top and the broad base thus insures that the rocking device will not tilt over sideways even if rocked quite violently.

A pair of end seats are provided and mounted on top of the cross member of the rocking device according to the present invention. Each end seat extends a small amount outwardly past the end of the cross member and has an area that overlaps the cross member enough so that a child may place his fingers underneath the seat and grasp the seat. The seat does not overlap the cross member enough so that the child's fingers will be pinched between the seat and the ground, however, the cross member always abuts the ground before the seat and provides a stop against further movement of the seat toward the ground. The cross member extends a slight distance past the connection of the free ends of the rockers thereto in order to provide such stopping action. However, this distance is very small so that the ends seats do not extend a significant distance past the point of the free ends of the rockers which are connected together. Such an arrangement between the seats and rockers normally requires that a child sitting on an end seat dispose his legs and toes inside the volume defined by the rockers and the plane of the cross member. Thus, for normal use of the device of the invention, a child's toes will not be in position so that they could be squashed by the rockers. Feet rests are provided extending between the rockers at necessary points in order to provide a safe place for the child's feet to be placed.

Hand holds are provided for the children using the device located on the cross member between the end seats, and if desirable a middle seat or seats between the hand holds may be provided. Accessory rod means also may be provided for spacing the rockers apart a desired distance at the middle and bottom portions thereof, and additional support for the cross member extending upwardly from the rockers and the accessory rod means at the middle portions of the cross member may also be provided. While the device according to the present invention is safe, it is still fun to use. Children using it are able to rock through a complete angle of about 68°. It is relatively inexpensive to construct and it is essentially readily constructed utilizing only commercially available steel rods and seats.

It is the primary object of the present invention to provide a safer rocking device for children, yet one that is fun to use and inexpensive to construct. This and other objects of the invention will become clear from an inspection of the detailed description of the invention and from the appended claims.

DETAILED DESCRIPTION OF THE INVENTION

Figure 1:
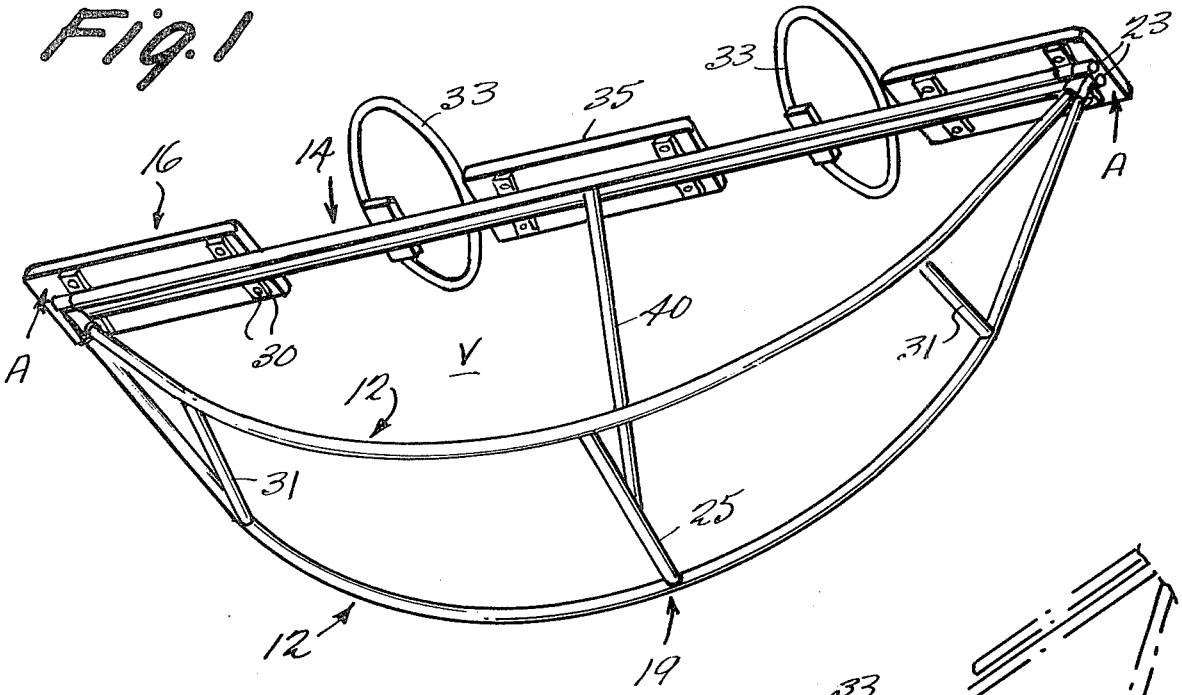
FIG. 1 is a perspective view of an exemplary rocking device according to the present invention.

An exemplary rocking device according to the present invention is shown in the drawings, including three major components, a pair of rockers 12, a cross member 14 and a pair of end seat means 16. It is the particular relationship between these components which results in the advantages of the present invention over the prior art proposals. The rockers 12 each have a pair of free ends 18 thereof and middle portions 19 thereof, and are curved between the free ends 18 thereof. The rockers may be made of a steel rod, as shown in the drawings, or other suitable material having sufficient strength characteristics. The free ends 18 of rockers 12 are connected substantially in abutting relationship to each other. Although they may be slightly spaced apart, they are preferably connected together to form a pair of rocker free end sets 20, 21.

Figure 2:
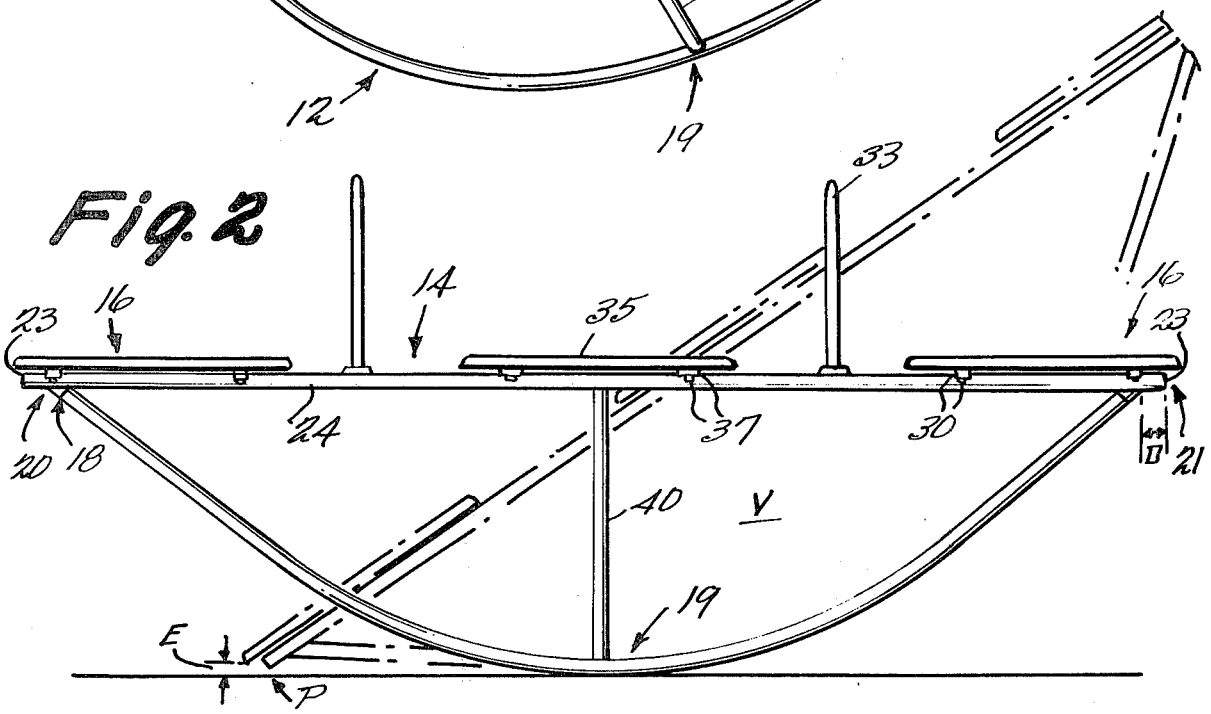
FIG. 2 is a side view of the rocking device of FIG. 1 showing a balanced position thereof in solid line, and showing the most extreme rocking position thereof on the dotted line.
Figure 3:
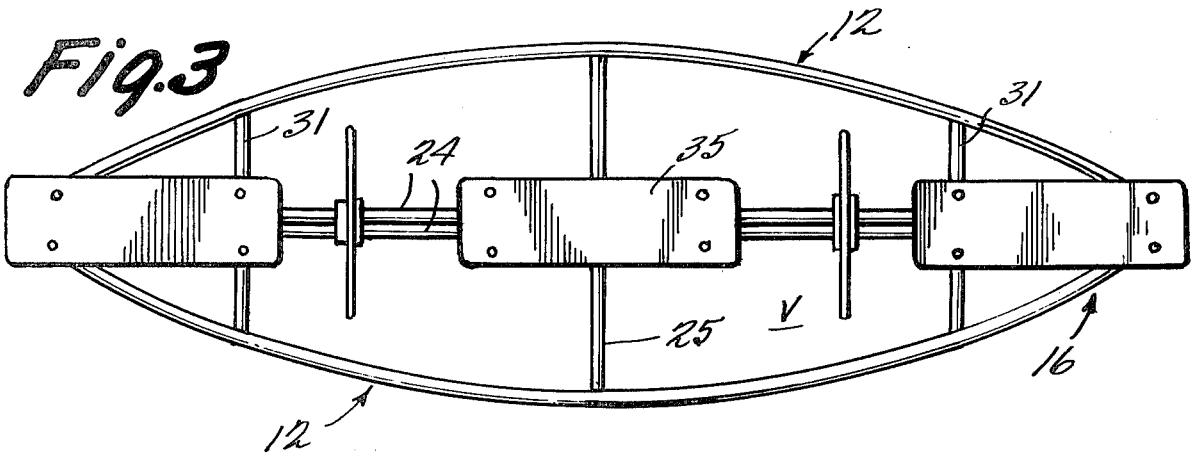
FIG. 3 is a top plan view of the rocking device of FIG. 1.

The free end sets 20, 21 of the rockers 12 preferably are connected to the cross member 14 adjacent to the free ends 23 of the cross member 14, as shown most clearly in FIG. 2. The cross member may comprise one or more steel rods 24 extending between the free end sets 20, 21 of the rockers 12, with the ends 23 of the cross member 14 overlapping the connection of the rockers 12 thereto, therefore a slight distance of D. Although the rockers are substantially abutting each other at the connections thereof to the cross member 14, they are spaced relatively widely from each other at the bottom middle portions 19 thereof (see FIGS. 1 and 3 in particular). A support member 25, which may be in the form of a steel rod, may extend between the rockers 12 at the middle portions 19 thereof to space the rockers a proper distance. The rockers 12 may be connected to the cross member 14 by any suitable conventional means, such as by bolts or by welding. As shown in FIG. 2, the free ends 18 of the rockers 12 may be flattened and the flattened free ends placed between the two rods 24 forming the cross member 14 and secured thereto by bolts or welding.

The distance D of the cross member free ends 23 past the point of connection between the rockers 12 is chosen so that it is sufficient to provide a stop for the rocking device as it is moved into its most extreme rocking position, as shown at the dotted line in FIG. 2. End seats 16, which may be constructed from plastic, wood, metal or other suitable material, are connected to the top of cross member 14 adjacent to the ends 23 thereof. Although the seats 16 do not extend a significant distance past the free ends 23 of the cross member 14, an area A of overlap of the seat 16 over the cross member 14 and rocker end sets 20, 21 is provided so that a child may place his fingers underneath a seat 16 and grasp the seat. The overlap area A is not large enough to extend a great enough distance past the ends 23 of the cross member, so that the child's fingers will be pinched between the seat and the ground. However, an end 23 of the cross member 14 touches the ground and stops any further movement of the seat toward the ground. With reference to FIG. 2, it is noted that the cross member end 23 touches the ground at the point P. The entire area A of seat 16 overlaps the cross member being spaced at least a distance E from the ground, and the distance E is larger than the thickness of a child's finger.

The seats 16 are mounted on top of the cross member 14 by any suitable means, such as bolts and brackets 30. The seats 16 are mounted with respect to the free end sets 20, 21 of the rockers 12 so that they do not extend any substantial distance past the end sets 20, 21. This means that normally when a child sits on a seat 16 he cannot put his feet outside the volume V defined by the rockers 12 and plane of cross member 14 and comfortably rock the rocking device more than a small amount. The child's feet must be placed within the volume V. Feet rests 31 are provided extended between rockers 12 at convenient places to allow for comfort when the child places his feet inside the volume V. With the feet inside the volume V, the child's toes are not in position to be squashed underneath the rockers 12 and the child can rock the device a maximum amount, to the dotted line position shown in FIG. 2. It is also noted that the provision of the stop by ends 23 at point P essentially prevents the rocking device from "rocking over." The provision of the relatively wide base at portions 19, compared to the relatively small spacing at ends 18, essentially prevents the device from tilting over sideways.

Preferably a pair of hand holds 33 are provided and mounted between the seats 16 on the cross member 14 to provide a place for the children using the device to hold on during rocking. While the child can safely grasp onto a seat 16 area A, in normal use of the device the child will hold onto a hold 33. The holds may be of any suitable size, shape and material, and the preferred holds in the drawings are closed circles formed from a steel rod. Also, a middle seat, or seats, 35 may be provided between the hand holds 33 and the seat 35 is attached, such as by brackets and bolts 37, to the top of the cross member 14. If desired, and especially when a middle seat 35 is provided, accessory supporting means may be provided for strengthening the middle area of the rocking device. Such accessory supporting means may take the form of a pair of rods extending from a point of connection to the cross member 14 at a middle portion thereof to the middle portions 19 of the rockers 12. An interior support rod 40 also may be provided, extending from the cross member 14 underneath middle seat 35 to the bottom support member 25. Support rod 40 may take any suitable form, such as steel rod of essentially the same diameter as the rest of the device. In fact, the whole rocking device may be constructed of a readily commercially available steel rod, except for the seats 16,35. Although the device according to the present invention is safe, a child can still have a great deal of fun rocking thereon since the total swing between the dotted line position, is about 68° for the dimensions of the device shown in the drawings.

A typical method of utilization of the device according to the present invention is as follows. Two children get on the device, one child on each end seat 16. Because of the relative locations of the end seats 16 and the end sets 20, 21 of the rockers 12, normally to rock the device any significant amount the children must place their feet on the feet rests 31 within the volume V defined by the rockers 12 and cross member 14. The children each hold on to a hand hold 33, and rock back and forth, being able to rock from the dotted line position in FIG. 2 to the other opposite extreme position, if desired. The children may grasp on to the seats 16 on the area A thereof, if desired, without fear of having their fingers squashed, because of the safety provided by the relative location of the cross member ends 23, the rocker end sets 20, 21 and the seats 16. Other children may join the fun by sitting on middle seat 35 and also grasping on to a hand hold 33. The ends 23 also essentially prevent the device from rocking over, while the wideness of the spacing between the middle portions 19 of the rockers 12 relative to the end sets 20, 21 spacing, essentially prevents the device from tilting over sideways.

It will thus be seen that according to the present invention a rocking device has been provided that provides completely safe fun for children and is relatively inexpensive to construct.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A rocking device comprising a. a pair of metal rod rockers, each rocker having a pair of free ends, and each rocker being curved between the free ends thereof;

b. means for attaching said free ends of said rockers to each other so that the rockers abut at the free ends thereof to provide free ends sets, but so that they are widely spaced from each other at middle portions thereof remote from said free ends thereof, said attaching means including a metal rod support member extending between said rockers at the middle, most widely spaced, portions thereof and attached to said rockers, c. a pair of metal rod cross members extending between the end sets of said rockers and connected to said rockers, said metal rod cross members in abutting engagement substantially along the entire length thereof, and said cross members and said rockers defining an interior volume of said rocking device, said cross members having free ends thereof extending past the point of connection of the rocker end sets with said cross members, said free ends providing stops for limiting the angle through which the rocking device may rock by abutting the surface on which said rocking device is rocking, and a metal rod support member extending downwardly from a middle portion of said cross members to said support member extending between said rockers, d. a pair of end seat means attached atop said cross members, each end seat means extending from substantially one set of free ends of said rockers toward the other set of free ends of said rockers so that an individual sitting on an end seat will normally have his feet disposed within the volume defined by said rockers and said cross members, said end seat means having an outer end area thereof overlapping said cross members a sufficient amount to allow an individual to place his fingers underneath said seat means and grasp said seat means, but not of sufficient overlapping amount so that an individual's fingers will be pinched between said seat means and the surface on which said rocking device is rocking, said cross members ends always abutting said surface before the outer ends of said end seat means, and stopping further movement of said end seat means toward said surface, e. a middle seat disposed between said end seats and attached to said cross members, and f. feet rest means extending between said rockers at positions wherein an individual sitting on an end seat may readily place his feet thereon with his toes generally disposed within the volume defined by said rockers and said cross members.

2. A rocking device recited in claim 1, further comprising a pair of spaced apart hand hold means attached to said cross members and disposed between said end seats, one hand hold means adapted to cooperate with each end seat.

* * * * *